US006669198B2

(12) United States Patent
Wichinsky

(10) Patent No.: US 6,669,198 B2
(45) **Date of Patent: *Dec. 30, 2003**

(54) METHOD OF PLAYING A MULTIPLE-DRAW POKER CARD GAME

(76) Inventor: Michael Wichinsky, 711 Lacy La., Las Vegas, NV (US) 89107

( * ) Notice: Subject to any disclaimer, the term of this patent is extended or adjusted under 35 U.S.C. 154(b) by 0 days.

This patent is subject to a terminal disclaimer.

(21) Appl. No.: 10/164,165

(22) Filed: Jun. 7, 2002

(65) Prior Publication Data

US 2002/0149153 A1 Oct. 17, 2002

Related U.S. Application Data

(63) Continuation-in-part of application No. 09/752,317, filed on Jan. 2, 2001, and a continuation-in-part of application No. 09/712,746, filed on Nov. 15, 2000, now abandoned.

(51) Int. Cl.[7] ..... A63F 1/00
(52) U.S. Cl. ..... 273/292
(58) Field of Search ..... 273/292, 274, 273/309; 463/13

(56) References Cited

U.S. PATENT DOCUMENTS

| | | | | | |
|---|---|---|---|---|---|
| 5,810,663 | A | * | 9/1998 | Bochichio et al. | 463/13 |
| 5,816,914 | A | * | 10/1998 | Wichinsky | 463/13 |
| 5,823,873 | A | * | 10/1998 | Moody | 463/13 |
| 6,007,066 | A | * | 12/1999 | Moody | 273/292 |
| 6,048,267 | A | * | 4/2000 | Wichinsky | 463/13 |
| 6,098,085 | A | * | 8/2000 | Blonder et al. | 715/531 |
| 6,129,357 | A | * | 10/2000 | Wichinsky | 273/292 |
| 6,132,311 | A | * | 10/2000 | Williams | 463/13 |
| 6,159,095 | A | * | 12/2000 | Frohm et al. | 463/19 |
| 6,435,509 | B2 | * | 8/2002 | Wichinsky et al. | 273/292 |

* cited by examiner

*Primary Examiner*—Steven Wong
*Assistant Examiner*—Dolores Collins
(74) *Attorney, Agent, or Firm*—Harry M. Weiss; Weiss, Moy & Harris, P.C.

(57) ABSTRACT

A new method of playing multiple-draw poker that provides players with the opportunity to progressively build poker hands by duplicating held cards from a latest completed hand into a new hand and also receiving a bonus hand in the form of a five-card poker hand, with no re-draws, that is by itself capable of receiving a predetermined bonus amount based on the poker hand value of the bonus hand.

8 Claims, 1 Drawing Sheet

METHOD OF PLAYING A MULTIPLE-DRAW POKER CARD GAME

CROSS-REFERENCE TO RELATED APPLICATIONS

This is a continuation-in-part of both U.S. patent application Ser. No. 09/712,746 filed Nov. 15, 2000 and U.S. patent application Ser. No. 09/752,317 filed Jan. 2, 2001, all having the name of the Applicant as at least one inventor, to which priority is claimed.

FIELD OF THE INVENTION

This invention relates generally to card games and methods therefor and, more particularly, to a method of playing multiple-draw poker that would provide players with a bonus hand and provide players with the opportunity to progressively build poker hands by duplicating held cards from a previous hand into a new hand.

BACKGROUND OF THE INVENTION

Many card games have been developed over the years for both social and gambling purposes. Poker, with all of its variations, is perhaps the most popular gambling card game. When playing against opponents, the general aim of poker is to collect a five card hand that is superior to opponents' five card hands or to try to bet in such a way (called "bluffing") as to cause opponents to believe that their hand is inferior and subsequently "fold" (concede or turn in) their hand. In video poker, however, there are often no opponents and therefore no bluffing. Winning at video poker generally means collecting a five card hand of at least a minimum predetermined value.

Many people find that the basic game of poker has become somewhat stale and boring. Attempts have been made to liven up the game in several different ways. In video poker machines, for example, variations on the game of poker exist which cannot be found in casino poker rooms (e.g., wild cards and jokers). In addition, some video poker machines allow the player to play multiple hands of poker simultaneously. In one popular variation known as Triple Play® the player receives three hands of poker. One Triple Play® variation is covered in U.S. Pat. No. 5,823,873 issued to Moody. In that variation, after receiving an initial hand of five cards, the player can choose to select as few as zero and as many as all of the five cards as cards to be held. All held cards from the initial hand immediately show up in the remaining two hands. When the player then selects the draw function, the video poker machine completes all three hands up to five cards, making a five card hand in each of the three hands. Similar variations allow as many as 10 hands of poker to be played simultaneously in the same fashion.

However, when playing against opponents in a live game, or playing video poker gaming machines (including Triple Play® and its variations) the player is generally limited to exercising his or her discretion in the selection process only during the initial hand of a single game, and before the player draws cards to complete the hand. The player therefore cannot progressively build future poker hands based on previously completed (i.e., post-draw) poker hands. In Triple Play® and its variations, it is generally only with the initial hand that the player may choose which cards to hold and which cards to discard. After the cards in the initial hand have been selected, those same cards are automatically selected in all remaining hands, eliminating the opportunity for any future selection process in any of the remaining hands which could lead to building progressively better poker hands. For example, in prior art games, if an initial hand in multiple-draw poker includes two Jacks and the player selects them as cards to be held (while at the same time discarding the three other cards) then the second hand and all other subsequent hands will include those same pair of Jacks. In these prior art games, if, in the second hand, the player draws three more cards to complete his or her hand and receives a third Jack (and two other cards of no poker value) this player has no ability to make that third Jack a held card for a third hand, and so on. The prior art does not allow a player to progressively build poker hands by continuing to duplicate cards to be held from previously completed (i.e., after the draw) hands.

Additionally, when a player selects less than five cards according to the Moody patent, not only are those cards duplicated for all remaining hands, but every hand, including the first hand are dealt new cards to complete their hand. However, subsequent hands are more likely to have better poker hands than the initial hand because subsequent hands have the benefit of the best kept cards of the initial hand. Players, therefore, have a greater chance of achieving good poker hands in subsequent hands rather than in the initial hand. Applicant has determined that contrary to the disclosure of the Moody Patent, it is in the player's best interest, therefore, to receive replacement cards for subsequent hands before receiving replacement cards for the initial hand, since one would rather receive a helpful card (e.g., another Jack) in the second hand which could be passed on to the third hand (e.g., which might give the player an opportunity to receive four Jacks for the third hand because the third hand will have received the three Jacks from the second hand) than in the first hand (e.g., which might only give the player for that first hand only three Jacks).

Another popular form of poker is known as Caribbean Stud Poker, in which players compete against the dealer for the best poker hand. The players and the dealer are each dealt five cards, and neither the players nor the dealer are permitted to draw any additional cards. If the player's hand is better than the dealer's hand in Caribbean Stud Poker, the player can be paid a multiple of his or her wager based on the poker hand value of his or her hand (for example, three of a kind typically pays 3 to 1 and a straight flush typically pays 50 to 1.) Unlike classic draw poker, one of the main distinguishing characteristics of Caribbean Stud Poker is its emphasis on the dealt hand, with no possibility of improvement by drawing additional cards. A single dealt hand with no re-draws is a simple way in which one can be paid a multiple of a wager based on a pre-determined list of poker hand values. Currently, the simplicity of Caribbean Stud Poker has not been incorporated into a video or multiple-draw poker game. Applicant has determined that a single, Carribean Stud-like hand of five cards could be dealt as a bonus hand at the end of a multiple-draw poker hand, allowing a player, in addition to trying to win with each one of the draw-poker hands, to receive a single five-card hand that could be paid a multiple of the player's wager or a jackpot payoff for achieving one of a pre-determined list of poker hand values.

A need therefore existed for providing a new, exciting method of playing multiple-draw poker that would provide players with the opportunity to progressively build poker hands by duplicating held cards from a latest completed hand into a new hand while at the same time receiving a bonus hand in the form of a five-card poker hand, with no re-draws, that would enable a player to win a predetermined amount of money (or other prize) based on the poker hand value of the bonus hand.

SUMMARY OF THE INVENTION

An object of the present invention is to provide a new method for playing multiple-draw poker in which a player has the opportunity to select which cards to hold in each hand of a multiple-draw poker game, and receive replacement cards for subsequent hands, but not for the initial hand until after the replacement cards are received for the subsequent hands.

It is a further object of the present invention to provide a new method for playing multiple-draw poker in which a player has the opportunity to progressively build poker hands by duplicating held cards from a latest completed hand into a new hand such as from the second hand into the third hand.

It is yet a further object of the present invention to provide a new method for playing multiple-draw poker in which a player has the opportunity to wager separate amounts on each hand of a multiple-draw poker game.

It is still a further object of the present invention to provide a new method for playing multiple-draw poker in which a player receives a "bonus hand" of five cards after receipt of the multiple draw five card hands, thereby enabling the player to be paid a predetermined amount of money or a jackpot payoff based on the poker hand value of the five card bonus hand irrespective of the results of each of the previous five card draw poker hands.

BRIEF DESCRIPTION OF THE PREFERRED EMBODIMENTS

In accordance with one embodiment of the present invention, a method for playing a multiple-draw card game of poker is disclosed comprising, in combination, the steps of dealing a first hand of at least five cards, selecting as few as none and as many as all of the at least five cards of the first hand as cards to be held, duplicating the held cards of the first hand into a second hand, drawing additional cards to complete the second hand to have at least five cards, providing an option of selecting as few as zero and as many as all of the at least five cards of the second hand as cards to be held, duplicating the held cards of the second hand into a third hand, drawing additional cards to complete the third hand to have at least five cards, drawing additional cards to complete the first hand, and determining a poker hand value of a completed first hand, a completed second hand and a completed third hand.

In accordance with another embodiment of the present invention, a method for playing a multiple-draw card game of poker is disclosed comprising, in combination, the steps of dealing a first hand of at least five cards, selecting as few as none and as many as all of the at least five cards of the first hand as cards to be held, duplicating the held cards of the first hand into a second hand, providing an option of selecting as few as zero and as many as all of the at least five cards of the second hand as cards to be held, duplicating the held cards of the second hand into a third hand, drawing additional cards, if needed, to complete the first, second and third hand to have at least five cards, drawing five additional, non-replaceable cards for a bonus poker hand, and determining a poker hand value of a completed first hand, a completed second hand, a completed third hand, and if the five additional non-replaceable cards qualify as a bonus poker hand.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

The present invention includes several embodiments of a method for playing a multiple-draw card game of poker, preferably on video gaming machines.

Figure 1:
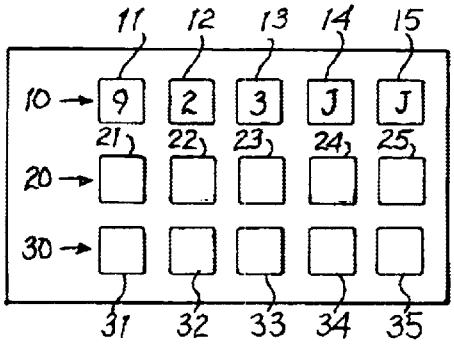
FIG. 1 is a top view of the preferred embodiment of the present invention showing an initial hand exposed in the first row, after the initial deal of five cards.

Referring to FIG. 1, three rows of cards are shown, consisting of a first hand 10, a second hand 20 and a third hand 30. The first step in the method is the dealing of a first hand 10 of at least five cards. In FIG. 1, the first hand 10 has already been dealt and the exposed cards happen to be: Nine of Diamonds 11, Two of Clubs 12, Three of Hearts 13, Jack of Spades 14 and Jack of Diamonds 15. The second hand 20 and the third hand 30 are shown with their cards face down. Although the first hand 10 is shown with five cards, it should be understood that more than 5 cards could be used to obtain a poker hand, such as in the poker game 7-card stud, and that this would be within the spirit and scope of this invention. While the first hand 10 is shown as the top five card hand, the first hand 10 can be, if desired, the middle or bottom five card hands. The second step of the method for playing a multiple-draw card game of poker is to select as few as none and as many as all of the cards 11, 12, 13, 14, and 15 of the first hand 10 as cards to be held.

Figure 2:
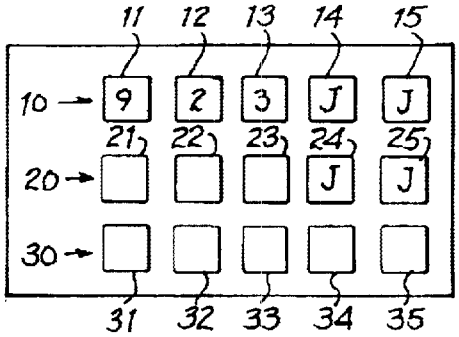
FIG. 2 is a top view of the preferred embodiment of the present invention showing the initial hand exposed in the first row and the second hand in the second row with the held cards from the first hand exposed in the second row.

Referring now to FIGS. 1 and 2, given the composition of the poker hand 10, the player would most likely hold the Jack of Spades 14 and the Jack of Diamonds 15 (thereby discarding the remaining cards Nine of Diamonds 11, Two of Clubs 12, and Three of Hearts 13) and attempt to draw a higher ranked poker hand, such as two-pair, three-of-a-kind, a full-house or four-of-a-kind. It should be understood, however, that the player has the decision to discard all five cards 11, 12, 13, 14, and 15 or hold all five cards 11, 12, 13, 14, and 15 or hold some of the cards 11, 12, 13, 14, and 15 while discarding others. Once the player selects the cards to be held, in this case, the Jack of Spades 14 and the Jack of Diamonds 15, those cards are then duplicated into a second hand 20 where they take the place of the face-down cards 24 and 25. In the preferred embodiment, the drawn cards are dealt face-up, avoiding the need for the player to have to press a button or turn the cards over by him or herself, however, it should be understood that substantial benefit, such as increased suspense and excitement, could be derived from the cards being dealt face-down, therefore requiring the player to have to press a button or turn the cards over by him or herself.

Figure 3:
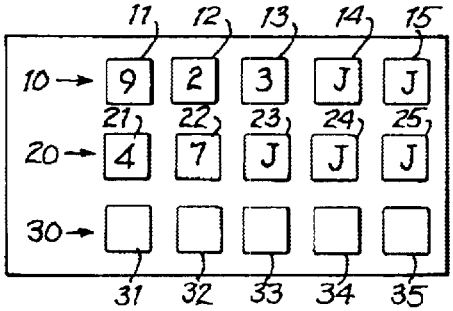
FIG. 3 is a top view of the preferred embodiment of the present invention showing the initial hand exposed in the first row and the completed second hand exposed in the second row including the held cards from the first hand.

Referring now to FIG. 3, the player can then draw additional cards to complete the second hand 20 to have at least five cards. (In FIG. 2, this would require revealing cards 21, 22 and 23). Preferably, the second hand 20 is completed before replacing unselected cards for the first hand 10 thereby providing the second hand 20 with an opportunity to receive a better second hand 20 than can be achieved if one or more of the hand enhancement cards for the second hand were first drawn for completion of the first hand 10 (by replacing cards not selected for the first hand 10). These cards turned-out to be the Four of Diamonds 21, the Seven of Clubs 22, and the Jack of Hearts 23. The player can now select as few as zero and as many as all of the at least five cards of the second hand 20 as cards to be held. Given the composition of the poker hand 20, the player would most likely hold the Jack of Spades 24, the Jack of Diamonds 25, and the Jack of Hearts 23 (thereby discarding the remaining cards 21 and 22) and attempt to draw a higher ranked poker hand such as a full-house or four-of-a-kind.

Figure 4:
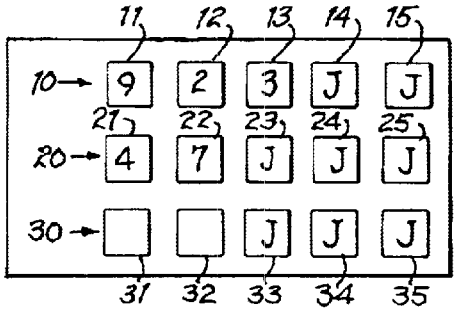
FIG. 4 is a top view of the preferred embodiment of the present invention showing the initial hand exposed in the first row, the completed second hand exposed in the second row including the held cards from the first hand, and the third hand in the third row with the held cards from the second hand exposed in the third row.

Referring now to FIG. 4, once the player selects the cards to be held, in this case, the Jack of Spades 24, the Jack of Diamonds 25, and the Jack of Hearts 23, those cards are then duplicated into a third hand 30 where they take the place of the face-down cards 33, 34 and 35 (shown in FIG. 3).

Figure 5A:
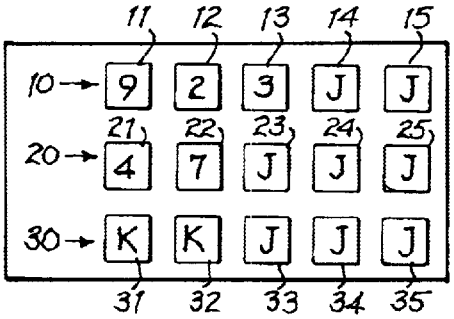
FIG. 5*a* is a top view of the preferred embodiment of the present invention showing the initial hand exposed in the first row, the completed second hand in the second row exposed including the held cards from the first hand, and the completed third hand exposed in the third row including the held cards from the second hand.

Referring now to FIG. 5*a,* additional cards are now drawn to complete the third hand 30 to have at least five cards. This would require revealing face-down cards 31 and 32 (shown in FIG. 4). In this case, the cards turned out to be the King of Diamonds 31 and the King of Clubs 32, giving the player a full-house. Once all of the hands have been completed, the poker hand value is determined of the completed first hand 10, the completed second hand 20 and the completed third hand 30. In the preferred embodiment, the method for playing a card game of poker involves three hands, however, it is possible to implement this same method with four or more hands. With more than three hands, the poker hand values of all of the hands are determined, and the method is complete, after all hands have been completed.

In the preferred embodiment, the player may wager money on the card game and receive a predetermined amount of money back if one or more of the player's completed hands meets a predetermined poker hand value. In this way, it is possible that the player could lose money on one or more of the hands and make money on one or more of the hands, or lose money on all of the hands, or make money on all of the hands.

Preferably, the game is played with a single fifty-two card deck (not counting the duplicated cards), although there are several alternative embodiments. One possible embodiment would be to use multiple decks in which a single fifty-two card deck is used for the first hand 10 and then the second hand 20 uses a forty-seven card deck consisting of a standard fifty-two card deck with the five cards 11, 12, 13, 14 and 15 of the first hand 10 omitted therefrom and the third hand 30 also uses a forty-seven card deck consisting of a standard fifty-two card deck with the five cards 21, 22, 23, 24 and 25 of the second hand 20 omitted therefrom, and so on, whereby additional hands beyond the third hand 30 all use forty-seven card decks consisting of standard fifty-two card decks with the five cards of the previously completed hand omitted therefrom.

Figure 5B:
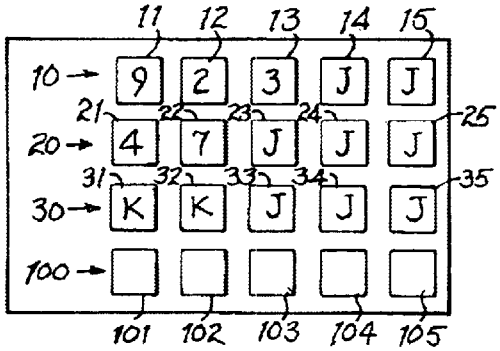
FIG. 5*b* is a top view of an alternative embodiment of the present invention showing the initial hand exposed in the first row, the completed second hand in the second row exposed including the held cards from the first hand, the completed third hand exposed in the third row including the held cards from the second hand, and a bonus five card hand in the fourth row.
Figure 5C:
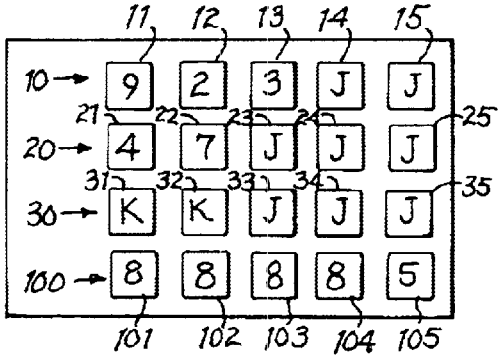
FIG. 5*c* is a top view of the alternative embodiment of FIG. 5*b* of the present invention showing the initial hand exposed in the first row, the completed second hand in the second row exposed including the held cards from the first hand, the completed third hand exposed in the third row including the held cards from the second hand, and a bonus hand exposed in the fourth row.

Referring now to FIGS. 5*b*–5*c,* an alternative embodiment of the present invention is shown. The alternative embodiment is essentially the same as the preferred embodiment, although a bonus hand 100 of at least five cards is also dealt. The bonus hand 100 is in the form of a single five-card poker hand (although it is within the scope of this invention if the bonus hand 100 is a seven-card poker hand), with no re-draws. The cards 101, 102, 103, 104 and 105 of the bonus hand 100 are preferably dealt face down, and not revealed until after poker hands 10, 20 and 30 have been completed, although it should be clearly understood that the cards 101, 102, 103, 104 and 105 of the bonus hand 100 should be revealed prior to the completion of poker hands 10, 20, 30 and other poker hands (in the event that the multiple-draw poker game uses more than three poker hands). Alternatively, the bonus hand 100 can be both dealt and subsequently revealed after the completion of the three poker hands 10, 20 and 30. In FIG. 5*b,* the cards 101, 102, 103, 104 and 105 of the bonus hand 100 are shown face down. In FIG. 5*c,* the cards 101, 102, 103, 104 and 105 of the bonus hand 100 are exposed to show the 8 of Diamonds, 8 of Hearts, 8 of Spades, 8 of Clubs and the 5 of Hearts. After the bonus hand 100 is dealt, a poker hand value of the bonus hand 100 is determined. The player can then preferably be paid a predetermined amount of money based on the poker hand value of the bonus hand 100, This can turn out to be a significant additional compensation bonus for a player playing prior multiple-draw poker video games because no such additional bonus poker hand has been previously provided. Referring now to FIG. 5*c,* this four-of-a-kind hand could then receive a jackpot payment or another predetermined bonus amount regardless of the outcome of the first hand 10, second hand 20, or third hand 30. Therefore, it is conceivable that the player could lose money on one or more of the poker hands 10, 20, and 30 and still make a significant amount of money on the bonus hand 100, or win money on all of the poker hands 10, 20, and 30 and make bonus money on the bonus hand 100.

While the invention has been particularly shown and described with reference to preferred embodiments thereof, it will be understood by those skilled in the art that the foregoing and other changes in form and details may be made therein without departing from the spirit and scope of the invention.

I claim:

1. A method for playing a multiple-draw card game of poker comprising, in combination, the steps of:

dealing a first hand of at least five cards;

selecting as few as none and as many as all of said at least five cards of said first hand as cards to be held;

duplicating said held cards of said first hand into a second hand;

drawing additional cards if needed to complete said second hand to have at least five cards;

providing an option of selecting as few as zero and as many as all of said at least five cards of said second hand as cards to be held for said second hand;

duplicating said held cards of only said second hand into a third hand;

drawing additional cards if needed to complete said third hand to have at least five cards;

drawing after completion of said third hand additional cards to complete the first hand; and determining a poker hand value of a completed first hand, a completed second hand and a completed third hand.

2. The method of claim 1 further comprising the steps of:

a player wagering a wager on said card game; and paying said player a predetermined amount based on said poker hand value of said first hand after it is completed, and said completed second hand and said completed third hand.

3. The method of claim 1 further comprising the steps of:

a player wagering a first wager on said first hand and a second wager on said second hand and a third wager on said third hand;

paying said player a predetermined amount based on said poker hand value of said first hand after it is completed;

paying said player a predetermined amount based on said poker hand value of said completed second hand; and paying said player a predetermined amount based on said poker hand value of said completed third hand.

4. The method of claim 1 wherein said multiple-draw card game of poker uses a single 52 card deck.

5. The method of claim 1 further comprising the steps of:

dealing a bonus hand of at least five cards which is in addition to and after dealing and completing said first, second and third hands, and determining a bonus poker hand value of said bonus hand.

6. The method of claim 5 further comprising the step of paying a player a predetermined amount based on said bonus poker hand value of said bonus hand.

7. A method for playing a multiple-draw card game of poker comprising, in combination, the steps of:

dealing at least a first hand of at least five cards, a second hand of at least five cards and a third hand of at least five cards;

selecting as few as none and as many as all of said at least five cards of said first hand as cards to be held;

duplicating said held cards of said first hand into at least a second hand, subsequently completing said first hand, said second hand and a third hand with said second hand and said third hand having at least held cards, if any are held, from said first hand;

dealing a bonus hand of at least five cards which is in addition to and follows dealing and completing said first, second and third hands; and determining a poker hand value of the completed first hand, the completed second hand, the completed third hand and a bonus poker hand value of said bonus hand.

8. The method of claim 7 further comprising the step of paying a player a predetermined amount for achieving at least a specified poker hand value for the said completed first hand, said completed second hand, and said completed third hand and a bonus amount for achieving a specified bonus poker hand value for said bonus poker hand.

* * * * *